United States Patent [19]

Gilhaus

[11] Patent Number: 5,039,373

[45] Date of Patent: Aug. 13, 1991

[54] SPLICING APPARATUS FOR FIBER TOWS INCLUDING AUTOMATIC CUTTING MEANS

[75] Inventor: Konrad F. Gilhaus, Bielefeld, Fed. Rep. of Germany

[73] Assignee: Seydel Vermögensverwaltungsgesellschaft mbH, Bielefeld, Fed. Rep. of Germany

[21] Appl. No.: 455,278

[22] Filed: Dec. 22, 1989

[30] Foreign Application Priority Data

Jan. 10, 1989 [DE] Fed. Rep. of Germany ... 8900201[U]

[51] Int. Cl.[5] ..... B65H 69/06

[52] U.S. Cl. ..... 156/433; 156/441; 156/502; 156/158; 57/23; 57/350; 57/908; 57/22

[58] Field of Search ..... 57/22, 23, 350, 908; 156/157, 158, 441, 433, 502

[56] References Cited

U.S. PATENT DOCUMENTS 3,339,362 9/1967 Dodson, Jr. et al. ..... 57/22
3,871,164 3/1975 Nunn ..... 57/22
4,199,928 4/1980 Cristaldi ..... 57/22

FOREIGN PATENT DOCUMENTS 3713286 11/1988 Fed. Rep. of Germany .

*Primary Examiner*—Michael W. Ball
*Assistant Examiner*—Jeff H. Aftergut
*Attorney, Agent, or Firm*—Robert W. Becker & Associates

[57] ABSTRACT

An apparatus for splicing the tow ends of man-made fiber tows, including a pair of jet carriers having oppositely directed pairs of jets to which compressed air can be supplied, whereby the connection of tow ends introduced between the pair of jet carriers is effected by aerodynamic turbulence. In order to enable an automatic splicing procedure, the pair of jet carriers is disposed on a jet carrier transport device that is movable in a direction transverse to the longitudinal orientation of the fiber tows. In addition, a cutting mechanism is provided that is movable parallel to the jet carrier transport device and cuts off projecting fiber ends after completion of splicing. A holding device having holders fixes the tow ends in position.

11 Claims, 3 Drawing Sheets

Fig.3a
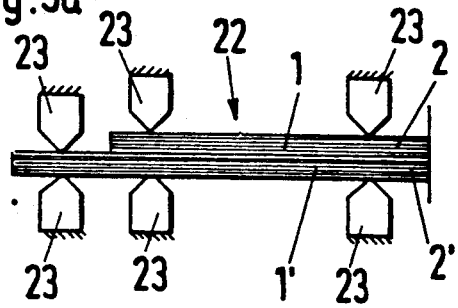
Fig.3b
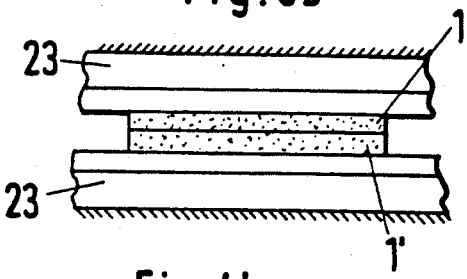
Fig.4a
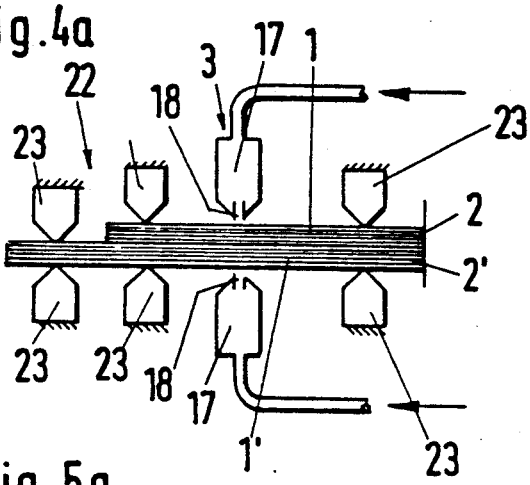
Fig.4b
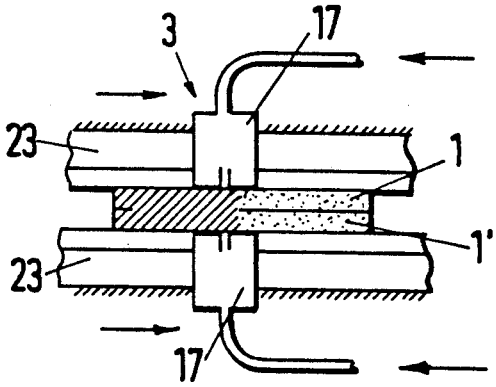
Fig.5a
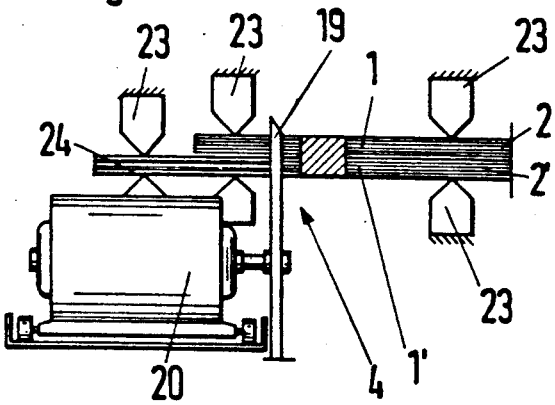
Fig.5b
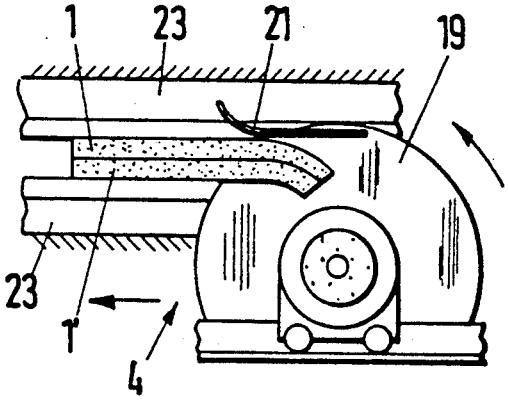
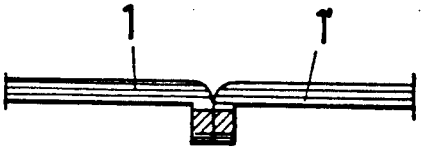
Fig.6
Fig.7
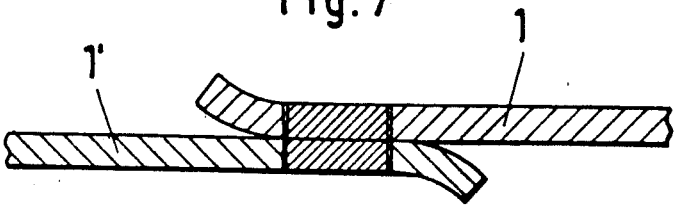

SPLICING APPARATUS FOR FIBER TOWS INCLUDING AUTOMATIC CUTTING MEANS

BACKGROUND OF THE INVENTION

The present invention relates to an apparatus for splicing the tow ends of man-made fiber tows. The apparatus includes one or more pairs of nozzles or jets that are disposed on a pair of jet carriers in such a way that the jet pairs are spaced from and directed toward one another. Compressed air is supplied to the jets, whereby splicing of the two tow ends, which are disposed on top of one another in a flat or sheet-like manner between the pair of jet carriers, is effected via aerodynamic turbulence.

It is frequently an objective when manufacturing man-made fibers to join together the ends of fiber tows. For example, it may be necessary to successively further process the contents of several canisters that are each filled with fiber tows. The respective beginnings and ends from the individual canisters are then expediently joined together so that after the processing of the content of one canister, the beginning of the contents of the next canister can be conveyed to the further processing stage without additional effort.

It is known to join tow ends by knotting or snarling them together. However, since the knots cannot be allowed to pass certain further processing stages such as, for example, fiber pile cutting machines, the process must always be interrupted if a knot enters the further processing stage. The knot is then cut out, the beginning of the subsequent tow is introduced into the further processing stage, and the process is restarted.

This manner of joining tow ends is obviously cumbersome. For this reason, German Offenlegungsschrift 37 13 286 proposed a splicing apparatus via which the tow ends were to be spliced together by aerodynamic turbulence. For this purpose, this known splicing apparatus is provided with pairs of jets that are disposed on a pair of jet carriers in such a way that the jets are spaced from and directed toward one another. The jets are supplied with compressed air so that the fibers of the tow ends, which are disposed on top of one another in a sheet-like manner and are introduced between the pairs of jets, are aerodynamically joined together by turbulence, so that via this braiding or interweaving, a connection is established between the ends of the man-made fiber tows.

Unfortunately, with this heretofore known splicing apparatus it is possible to join together only such tow ends that, in the flat state, do not exceed a certain width. As soon as the width of the tow ends exceeds a certain size, these tow ends must be moved back and forth by an operator transverse to the longitudinal orientation of the tow ends so that a splicing operation can be effected over the entire width of the tow ends. In so doing, the quality of the splice connection cannot be reproduced, and depends primarily upon the manual aptitude of the operator. In addition, this back and forth movement of the tow ends that are to be spliced together is personnel intensive. Furthermore, a drawback of the known splicing apparatus is that after the tow ends have been spliced, projecting fiber ends remain that may have to be cut off by hand by the operator using scissors.

It is therefore an object of the present invention to improve the heretofore known apparatus for splicing the ends of man-made fiber tows in such a way that a simpler operation is possible, where above all the splicing and cutting procedures should be capable of being carried out automatically.

BRIEF DESCRIPTION OF THE DRAWINGS

This object, and other objects and advantages of the present invention, will appear more clearly from the following specification in conjunction with the accompanying schematic drawings, in which:

FIG. 3*a* is a perspective view of the splicing process after the tow ends that are disposed on top of one another in a sheet-like manner are secured in position;

FIG. 3*b* is a view taken at right angles to that of FIG. 3*a;*

FIG. 4*a* is a view similar to that of FIG. 3*a*, but during splicing via aerodynamic turbulence;

FIG. 4*b* is a view taken at right angles to that of FIG. 4*a;*

FIG. 5*a* is a schematic illustration showing how projecting fiber ends are cut subsequent to the splicing procedure;

FIG. 5*b* is a view taken at right angles to that of FIG. 5*a;*

FIG. 6 shows spliced-together cable ends that are disposed on top of and parallel to one another in such a way that their ends face in the same direction; and FIG. 7 is a view similar to that of FIG. 6, whereby however the tow ends face in opposite directions.

SUMMARY OF THE INVENTION

Figure 1:
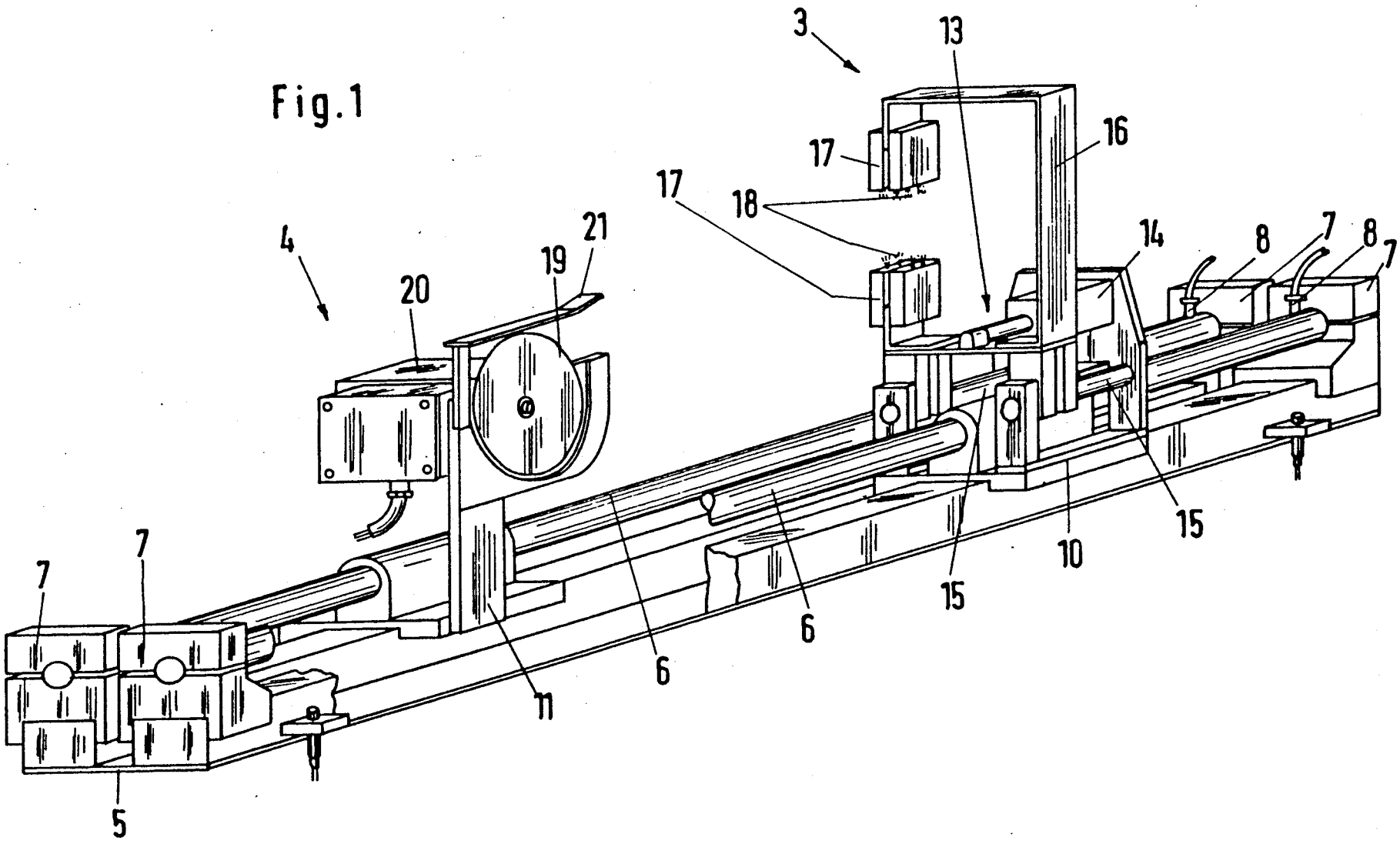
FIG. 1 is a perspective view of one exemplary embodiment of the inventive splicing apparatus.

The splicing apparatus of the present invention is characterized primarily by: a jet carrier transport device that is movable in a direction transverse to the longitudinal orientation of the man-made fiber tows, with the pair of jet carriers being disposed on the jet carrier transport device; a cutter transport device that is movable parallel to the jet carrier transport device; a cutting mechanism that is disposed on the cutter transport device and that serves to cut off projecting fiber ends after splicing of the tow ends is effected; and a clamping or holding device that includes clamping jaws or holding means disposed on opposite sides of a splicing location for fixing the superimposed tow ends in position during splicing and cutting-off procedures.

A splicing apparatus constructed pursuant to the teaching of the present invention has the advantage of permitting an automatic operating sequence not only with regard to the splicing but also with regard to the subsequent cutting-off of projecting fiber ends. It is merely necessary for an operator to secure the two tow ends, which are disposed on top of one another in a sheet-like manner, in position between the holding means of the holding device, thus assuring the required fixation. To splice the tow ends the nozzle pairs are then guided transversely, i.e. linearly, over the spreadout flat tow ends, so that the fibers are aerodynamically braided to thus achieve the required cohesion of the fibers of the two tow ends. After the splicing process has been concluded, the cutting mechanism can then be appropriately automatically actuated, with this device cutting off the projecting fiber ends by moving in the transverse direction. Finally, it is merely necessary for the operator to loosen the holding device so that the interconnected tow ends can be removed and can be conveyed for further processing. In principle, it is possible to dispose the two ends that are to be interconnected so that they are disposed on top of and parallel to one another in such a way that their ends point in the same direction. Alternatively, the ends could also point in opposite directions. In the same way, after the two ends have been secured in position, it is possible to braid these ends together in a narrow region.

Pursuant to one structural specific embodiment of the present invention, the jet carrier transport device and the cutter transport device are each preferably comprised of a hollow cylinder in which is disposed a pneumatically movable piston that carries along the associated splicing mechanism or cutting mechanism. This carrying or taking along of the splicing or cutting mechanism is preferably effected via a permanent magnet that is preferably disposed on the piston. The pneumatic actuation of the two directions of movement represents a technically straightforward possibility for transversely shifting not only the splicing mechanism but also the cutting mechanism. To effect the pneumatic actuation of the transport devices, it is possible to use the same source of compressed air that is used for the jets for splicing the tow ends. The use of permanent magnets for carrying along the splicing or cutting mechanism represents a straightforward structural possibility without having to take into consideration, for example, special sealing problems in the cylinder/piston unit, since no direct mechanical connection has to be provided between the piston and the splicing or cutting mechanism that has to be guided through the wall of the hollow cylinder.

Pursuant to a preferred specific embodiment of the present invention, the jet carrier transport device is provided with an additional oscillation movement device that imparts to the displacement movement of the pair of jet carriers resulting from the jet carrier transport device a cyclical linear movement of changing direction that is parallel to this displacement movement of the pair of jet carriers. In this manner, the jets carry out a so-called intermittent or pilgrim step motion; in other words, the jets are moved during the linear movement back and forth over the entire width of the tow ends that are to be spliced together, so that thereby an intensive braiding of the fibers is achieved since the air jets are guided several times over the same spot.

In this connection, the additional oscillation movement device is preferably a pneumatic cylinder/piston unit. This represents a technically straightforward possibility for the pilgrim step motion.

Pursuant to a further specific embodiment of the inventive splicing apparatus, the jet carriers of the pair of jet carriers are disposed on the free ends of legs of a horizontal U-shaped bracket. This represents a technically very straightforward possibility for guiding the jet carriers over the entire width of the spread-out flat tow ends.

The cutting mechanism is preferably provided with a rotating cutter blade. A cutting mechanism of this type in the form of a circular saw blade represents a technically straightforward possibility for being able to cut off in a reliable manner the projecting fiber ends of the spliced together tow ends. Preferably disposed above the cutter blade is a strip that presses the tow ends down to provide an orderly feeding of the tow material and thereby assure a reliable cutting procedure.

In principle, it is possible to manually operate the inventive splicing apparatus, i.e. to manually produce the splice and to manually cut off the projecting fiber ends, by having an operator manually control the movement sequence of the appropriate mechanisms. However, experience has shown that this offers no guarantee for a reproducible splice quality, either because directions for use cannot be maintained or the required manual skill is not present. In addition, the use of manually operable cutting devices forms a safety risk for the operator that is difficult to assess. For this reason, pursuant to a preferred specific embodiment of the present invention, a programmable electronic control mechanism is proposed for the splicing and cutting procedures of the man-made fiber tows. By means of this control mechanism, after the tow ends have been placed and secured in position the splicing and cutting procedures proceed automatically in conformity with a preselected program. In so doing, during the splicing and cutting procedures the tow ends and the processing elements, especially the cutter blades, are completely inaccessible to the operator. Only after it has been automatically shut down can the machine be opened. In addition to the safety aspect and the advantage of the reproducibility of the splice production, a reduction of the compressed air consumption to the minimum required is also possible.

Further specific features of the present invention will be described in detail subsequently.

DESCRIPTION OF PREFERRED EMBODIMENTS

Figure 2:
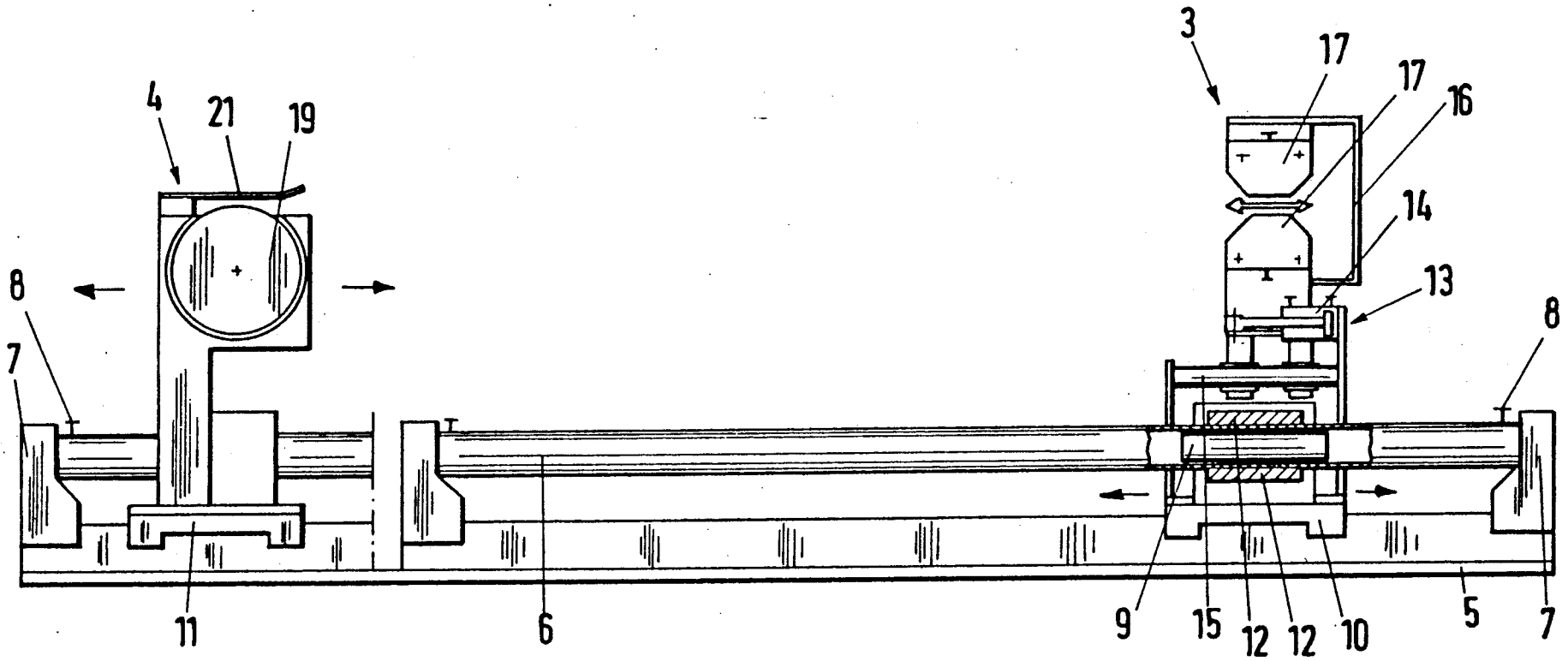
FIG. 2 is a side view of a splicing apparatus of FIG. 1.

Referring now to the drawings in detail, FIGS. 1 and 2 show a combined splicing and cutting apparatus for joining the two tow ends 1, 1' of two man-made fiber tows 2, 2'. The apparatus is provided with a linearly movable splicing mechanism 3 as well as a cutting mechanism 4 that is movable parallel thereto.

For this purpose, two hollow cylinders 6 are mounted parallel to one another on a base plate 5 via supports 7 that are disposed at the ends of the cylinders 6. In the region of these supports 7, each hollow cylinder 6 is provided with a compressed air connection 8. As can be seen from FIG. 2, a piston 9 is movably disposed within each hollow cylinder 6. Depending upon the direction of movement that is desired, displacement movement is effected by supplying compressed air to the hollow cylinder 6 either through the left or through the right compressed air connection 8. In so doing, the pistons 9 take along their respective splicing mechanism 3 or cutting mechanism 4, whereby for this purpose the mechanisms 3 and 4 are provided with a jet carrier transport device 10 and a cutter transport device 11 respectively, with these transport devices being movably mounted on their associated hollow cylinder 6 and each having a support frame through which the hollow cylinder 6 extends. The movement coupling between the pistons 9 and the respective transport devices 10, 11 is effected via permanent magnets 12 that are disposed in the respective transport device 10, 11. These permanent magnets 12 cooperate with the pistons 9, which for this purpose are made of an appropriate metal, so that a magnetic coupling is assured between the two materials in such a way that when a piston 9 moves, the associated permanent magnet 12, and hence the associated transport device 10, 11, is taken along and moves along the hollow cylinder 6.

Superimposed over the displacement movement of the jet carrier transport device 10 is a cyclical linear movement of changing direction. For this purpose, the jet carrier transport device 10 is provided with an additional oscillation movement device 13 in the form of a cylinder/piston unit 14. By activating both the jet carrier transport device 10 and the oscillation movement device 13, the splicing mechanism 3 carries out a so-called intermittent or pilgrim step motion. Guide rods 15 are provided to improve guidance of the splicing mechanism 3 relative to the jet carrier transport device 10 upon activation of the oscillation movement device 13.

The splicing mechanism 3 comprises a horizontal U-shaped bracket 16, the free ends on the legs of which are bent inwardly at right angles toward one another. Mounted on these ends are jet carriers 17, each of which is provided with four nozzles or jets 18. A free space is left between the two jet carriers 17, and appropriate jets 18 are directed at one another from opposite sides.

The cutting mechanism 4 comprises a disk-shaped, rotating cutter blade 19 that is driven by a motor 20. Disposed above this cutter blade 19 is a strip 21 that is preferably in the form of a yielding tongue.

Not illustrated in FIGS. 1 and 2 are the machine frame, a hinged protective hood or guard that is provided with safety features to prevent opening during a splicing or cutting procedure, as well as a clamping or holding device 22 on both sides of the splicing mechanism 3 and the cutting mechanism 4. This holding device 22 can be seen in the schematic views of FIGS. 3*a*, 3*b*, 4*a*, 4*b*, 5*a*, and 5*b*. Finally, the inventive splicing apparatus is also provided with a programmable electronic control mechanism that is similarly not illustrated and serves for an automatic programmed operating sequence of the individual procedures.

The operation of the inventive splicing apparatus will be described subsequently, in particular with the aid of FIGS. 3*a* to 5*b*:

First of all, as can be seen in FIGS. 3*a* and 3*b*, the tow ends 1, 1' of the man-made fiber tows 2, 2' that are to be joined together are disposed on top of one another in a flat or sheet-like manner and are securely held in position via clamping jaws or holders 23 of the holding device 22 in such a way that the tow ends 1, 1' are fixed for the subsequent splicing and cutting process.

The jets 18 of the splicing mechanism 3 are thereafter supplied with compressed air, and the splicing mechanism 3, by activation of both the jet carrier transport device 10 and the oscillation movement device 13, is moved over the width of the tow ends 1, 1' in such a way that the fibers are braided or interwoven in a narrow region by aerodynamic turbulence; this is indicated in FIG. 4*b* by cross hatching.

After conclusion of the splicing process, the cutting mechanism 4 is activated. For this purpose, first the cutter blade 19 is rotated and the cutter transport device 11 is activated in such a way that the cutter blade 19 is moved over the width of the spliced-together tow ends 1, 1', thereby cutting off the projecting fiber ends 24. During this process, the tongue-like strip 21 presses the tow ends 1, 1' downwardly in such a way as to assure a satisfactory cutting process, namely by ensuring that all of the fiber ends 24 are contacted by the cutter blade 19; this is illustrated in FIGS. 5*a* and 5*b*.

FIG. 6 shows the finished spliced connection of the tow ends 1, 1' in the position in which they enter a further treatment stage.

In the illustrated embodiment tow ends 1, 1' are spliced together that are disposed one on top of the other in a parallel arrangement in such a way that their ends point in the same direction. However, in place of this it is also possible to splice together tow ends 1, 1' that are disposed on top of one another in such a way that their ends point in opposite directions, as shown in FIG. 7. For this purpose, an apparatus is provided that includes one splicing mechanism and two cutting mechanisms.

The present invention is, of course, in no way restricted to the specific disclosure of the specification and drawings, but also encompasses any modifications within the scope of the appended claims.

What I claim is:

1. An apparatus for splicing the tow ends of man-made fiber tows, and including a splicing mechanism that comprises at least one pair of jets that are disposed on a pair of jet carriers in such a way that said jets are spaced from and directed toward one another, means being provided for supplying compressed air to said jets, whereby splicing of said two tow ends, which are disposed one on top of the other in a sheet-like manner between said pair of jet carriers, is effected via aerodynamic turbulence, with a jet carrier transport device that is movable in a direction transverse to the longitudinal orientation of said fiber tows, with said pair of jet carriers being disposed on said jet carrier transport device, with a holding device that includes holding means disposed on opposite sides of a splicing location for fixing said superimposed tow ends in position during splicing, said apparatus further comprising:

a cutter transport device that is movable parallel to said jet carrier transport device;

a cutting mechanism that is disposed on said cutter transport device and that serves to cut off projecting fiber ends after splicing of said two ends is effected.

2. An apparatus according to claim 1, in which said jet carrier transport device and said cutter transport device each include a hollow cylinder in which is disposed a pneumatically displaceable piston that takes along the associated splicing or cutting mechanism.

3. An apparatus according to claim 2, which includes permanent magnet means to effect said taking along of said splicing and cutting mechanisms.

4. An apparatus according to claim 3, in which said permanent magnet means are disposed on said pistons.

5. An apparatus according to claim 2, in which said jet carrier transport device is also provided with an oscillation movement device that imparts to forward movement provided for said pair of jet carriers a cyclical linear movement, of changing direction, that is parallel to said forward movement of said pair of jet carriers.

6. An apparatus according to claim 5, in which said oscillation movement device includes a pneumatic cylinder/piston unit.

7. An apparatus according to claim 2, which includes a horizontal, U-shaped bracket with legs having free ends on which said jet carriers are disposed.

8. An apparatus according to claim 2, in which said cutting mechanism includes a rotating cutter blade.

9. An apparatus according to claim 8, in which a strip is disposed above said cutter blade.

10. An apparatus according to claim 2, which includes a programmable electronic control mechanism for said splicing and cutting procedures for said fiber tows.

11. An apparatus for splicing the tow ends of man-made fiber tows, including:

a splicing mechanism that comprises at least one pair of jets that are disposed on a pair of jet carriers in such a way that said jets are spaced from and directed toward one another;

means for supplying compressed air to said jets, whereby splicing of said two tow ends, which are disposed one on top of the other in a sheet-like manner between said pair of jet carriers, is effected via aerodynamic turbulence;

a jet carrier transport device that is movable in a direction transverse to the longitudinal orientation of said fiber tows, with said pair of jet carriers being disposed on said jet carrier transport device;

a cutter transport device that is movable parallel to said jet carrier transport device;

a cutting mechanism that is disposed on said cutter transport device and that serves to cut off projecting fiber ends after splicing of said two ends is effected;

a holding device that includes holding means disposed on opposite sides of a splicing location for fixing said superimposed tow ends in position during splicing and cutting-off procedures;

said jet carrier transport device being provided with an oscillation movement device that imparts to forward movement provided for said pair of jet carriers a cyclical linear movement, of changing direction, that is parallel to said forward movement of said pair of jet carriers.

* * * * *